US012130105B2

(12) United States Patent
Byrd

(10) Patent No.: US 12,130,105 B2
(45) Date of Patent: Oct. 29, 2024

(54) AIDED RESET FIREARM TRIGGER MECHANISM

(71) Applicant: John Kyle Byrd, Rockingham, NC (US)

(72) Inventor: John Kyle Byrd, Rockingham, NC (US)

( * ) Notice: Subject to any disclaimer, the term of this patent is extended or adjusted under 35 U.S.C. 154(b) by 0 days.

(21) Appl. No.: 18/122,915

(22) Filed: Mar. 17, 2023

(65) Prior Publication Data

US 2023/0296341 A1 Sep. 21, 2023

Related U.S. Application Data

(60) Provisional application No. 63/320,834, filed on Mar. 17, 2022.

(51) Int. Cl.
*F41A 19/09* (2006.01)
*F41A 19/10* (2006.01)

(52) U.S. Cl.
CPC ..... *F41A 19/09* (2013.01); *F41A 19/10* (2013.01)

(58) Field of Classification Search
CPC ..... F41A 19/09; F41A 19/10
See application file for complete search history.

(56) References Cited

U.S. PATENT DOCUMENTS

| | | | | |
|---|---|---|---|---|
| 3,292,492 | A * | 12/1966 | Sturtevant | F41A 17/46 89/142 |
| 7,398,723 | B1 * | 7/2008 | Blakley | F41A 19/10 89/129.01 |
| 2014/0259845 | A1 * | 9/2014 | Johnson | F41A 19/09 42/69.01 |
| 2017/0219307 | A1 * | 8/2017 | Foster | F41A 17/76 |
| 2019/0186858 | A1 * | 6/2019 | Foster | F41A 17/46 |

* cited by examiner

*Primary Examiner* — Bret Hayes
(74) *Attorney, Agent, or Firm* — Robert J. Hess; Hess Patent Law Firm

(57) ABSTRACT

A trigger reset device that utilizes a base and a pivotal paddle to aid in the reset the trigger of a semi-automatic firearm that utilizes a bolt carrier group and single stage trigger. After each actuation of the trigger, the trigger reset device aids in the reset of the trigger at a rate faster than most amateur operators are able to release their finger off the trigger. The aided reset device thereby allows the operator to the fire the firearm at an enhanced rate.

9 Claims, 17 Drawing Sheets

AIDED RESET FIREARM TRIGGER MECHANISM

CROSS-REFERENCE TO RELATED APPLICATION

The present application claims priority to U.S. Provisional Patent Application No. 63/320,834 filed on Mar. 17, 2022, titled "Aided Reset Firearm Trigger Mechanism", the disclosure of which is incorporated herein by reference in its entirety.

FIELD OF THE INVENTION

The present disclosure relates to a novel trigger mechanism for use in semi-automatic firearm platforms. More particularly, the disclosure presents various exemplary embodiments of an aided reset firearm trigger mechanism that may be used, for example, in an AR-15 platform, the features of which may also be utilized in other semi-automatic firearm platforms as well.

BACKGROUND

Typical operation of a standard semi-automatic firearm utilizes a single actuation of the trigger to fire a single projectile. Actuation, sometimes understood as the "pull" of the trigger, may in some applications release a sear between the trigger and a spring-loaded or otherwise biased hammer, thereby causing the hammer to release towards and to contact a striker. Upon contact with the striker, a firing pin may be caused to contact a chambered round of ammunition, igniting gun powder or the like within the chamber, causing a projectile within the chambered round to fire. When designed appropriately, a portion of the resulting gases from the ignited gun powder can be utilized to impose a propulsion force that is transferred back to the bolt carrier group which, in conjunction with a recoil spring, can extract the spent cartridge case from the chamber, eject the case, chamber a new round, and reset the trigger mechanism.

A standard trigger mechanism for a semi-automatic firearm often utilizes a disconnector which typically rests on the top of the trigger. When the bolt carrier group recoils backwards from the gases produced in the spent projectile, it also pushes the hammer backwards away from the striker. The bolt carrier group then contacts a buffer spring, which returns the bolt carrier group to battery and chambers a new round in the process. The disconnector utilizes a second sear to catch the hammer before it can fully follow the bolt carrier group back to battery. This disconnector can be important because the typical shooter is unable to release the trigger before the bolt carrier group returns to battery. Accordingly, if the hammer is not stopped before the bolt carrier group returns to battery, the hammer will simply follow the bolt carrier group forward and rest on the striker without enough force to fire the next round, or the ability for the operator to dictate when the next round is fired via the trigger actuation.

While only a single round is fired, the hammer is held back by the disconnector so long as the operator holds the trigger down. Upon releasing the trigger, the disconnector disengages from the hammer just after the sear between the hammer and the trigger reengages. When the operator fully releases the trigger, the hammer and trigger sear is reset, and the next round is ready to be fired via a second actuation of the trigger.

Although this process happens very quickly, the rate of fire is still limited by how long it takes the operator to fully release the trigger and depress it again. To facilitate faster shooting (for example, for training or entertainment purposes), devices have been developed to aid the operator in faster actuation of the trigger.

One method developed to increase the fire rate of semi-automatic firearms includes the use of a mechanism that forcefully resets the trigger. One such example of this technology is described in U.S. Pat. Nos. 9,568,264; 9,816,772; and 9,939,221., all of which were issued to Thomas Allen Graves. These patents describe a device that forcefully resets the trigger forward, instead of requiring the operator to release the trigger. However, these inventions do not provide "drop-in" solutions for the most common firearm platforms such at the AR-15, AK47, and Ruger 10/22™. Drop-in devices allow for the user to simply take the old part out and replace with the new part with little to no other modification necessary. For example, to use the Graves' mechanism in an AR-15 platform, both the fire control mechanism and the bolt carrier group would need to be disadvantageously modified or replaced.

BRIEF SUMMARY OF THE INVENTION

The present disclosure includes a semi-automatic trigger reset mechanism that, in some embodiments, may use the recoil of the bolt carrier group to aid in the reset of the trigger forward after each round. More particularly, the present disclosure entails a mechanism that may transfer the forward recoiling force produced by the buffer spring into the bolt carrier group, which in turn may transfer the energy downward through a paddle that may be pivotally connected to a base via a rotating pin. In some embodiments, the bottom portion of the paddle may directly contact the rear trigger lever so that the downward force of the paddle pushes the rear trigger lever downward, which in turn may aid in the reset of the trigger forward. At the same time, the bolt carrier group returns to battery. This mechanism may be used in AR-15 platform rifles, for example, and with proper installation and use, may allow a typical operator to actuate the trigger at a more rapid rate when compared to just a normal semi-automatic trigger alone

DETAILED DESCRIPTION

The terminology used herein is for the purpose of describing particular embodiments only and is not intended to be limiting of the disclosure. As used herein, the term "and/or" includes any and all combinations of one or more of the associated listed items. As used herein, the singular forms "a", "an" and "the" are intended to include the plural forms as well as the singular forms, unless the context clearly indicates otherwise. It will be further understood that the terms "comprises" and/or "comprising" when used in this specification, specify the presence of stated features, steps, orientations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the relevant art. It will be further understood that terms, such as those defined in commonly used dictionaries, should be interpreted as having a meaning that is consistent with their meaning in the context of the relevant art and the present disclosure and will not be interpreted in an idealized or overly formal sense, unless expressly so defined herein.

It will be understood that a number of techniques and steps relating to the disclosure are presented. Each of these has individual benefits and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the inventions and the claims.

According to some embodiments, a device capable of aiding in resetting a trigger forward after each shot is presented. In the following description, for purposes of explanation, numerous specific details are set forth in order to provide a thorough understanding of the present disclosure. It will be evident, however, to one skilled in the art that the present disclosure may be practiced without these specific details. The present disclosure is to be considered as one or more examples only and is not intended to limit the disclosure to the specific embodiments illustrated by the figures or description below.

Figure 1:
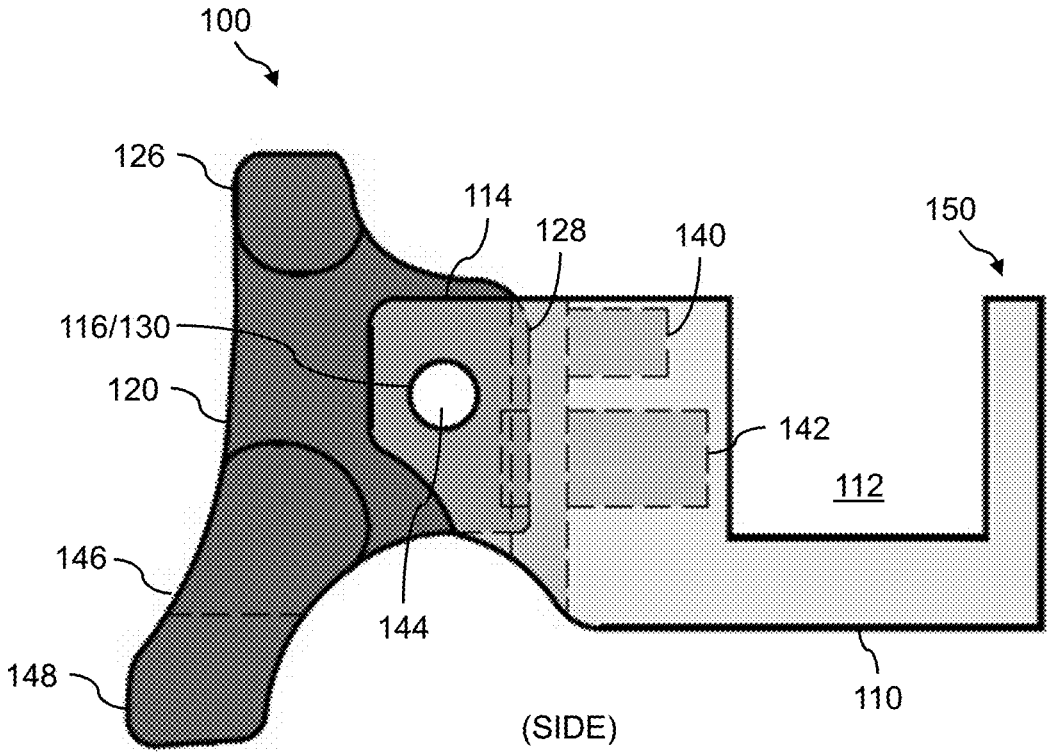
FIG. 1 illustrates a side view of an example of the presently disclosed aided reset trigger mechanism.

Referring now to FIG. 1, a side view of an exemplary trigger mechanism according to some embodiments of the present disclosure is presented. In certain preferred embodiments, each of the elements of the trigger mechanism may be assembled into a single "drop-in" aided reset trigger mechanism 100 for use in any one of the numerous popular semi-automatic firearm platforms, including but not limited to the AK-47, AR-15, AR-10, and Ruger 10/22™, among others, in any variant of caliber and configuration.

In some embodiments, the aided reset trigger mechanism 100 may include a base 110 attached to a paddle 120 via a rotating pin 144. The rotating pin 144 may be fitted through a base through-hole 116 and paddle through-hole 130. The base 110 may also contain a base notch 112 that may be sized to accompany the upper receiver take down pin post of a MIL-SPEC upper receiver. The base notch 112 may include a rear base support arm 150 that may, in some embodiments, extend parallel to a paddle connecting portion 128. The paddle connecting portion 128 may include an upper stop pin 140 and a lower spring 142.

Figure 2:
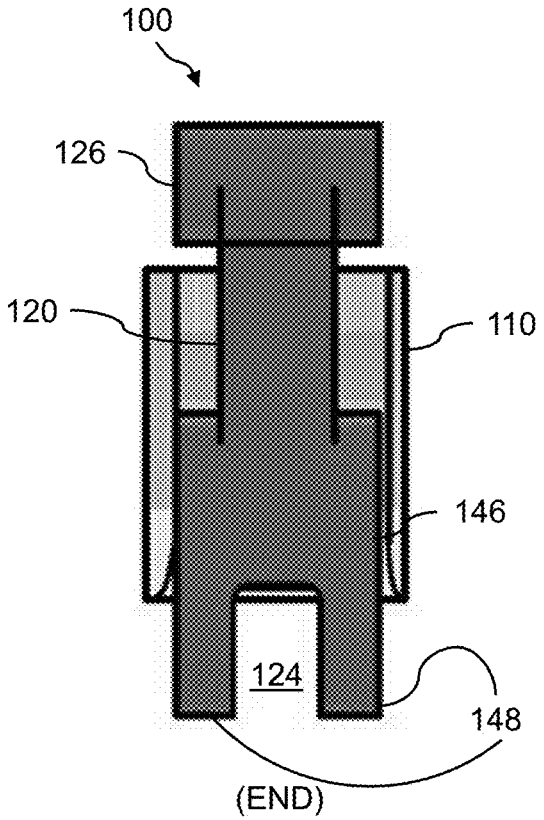
FIG. 2 illustrates an end view of an example of the presently disclosed aided reset trigger mechanism.

FIG. 2 shows a front view of the aided reset trigger mechanism 100. Notably, the front portion contains the paddle 120 which lies in front of the base 110. The paddle 120 is comprised of a paddle head 126 and a lower paddle 146. At the bottom portion of the lower paddle 146, two parallel paddle legs 148 extend downward creating a gap that forms the straddle slot 124.

Figure 3:
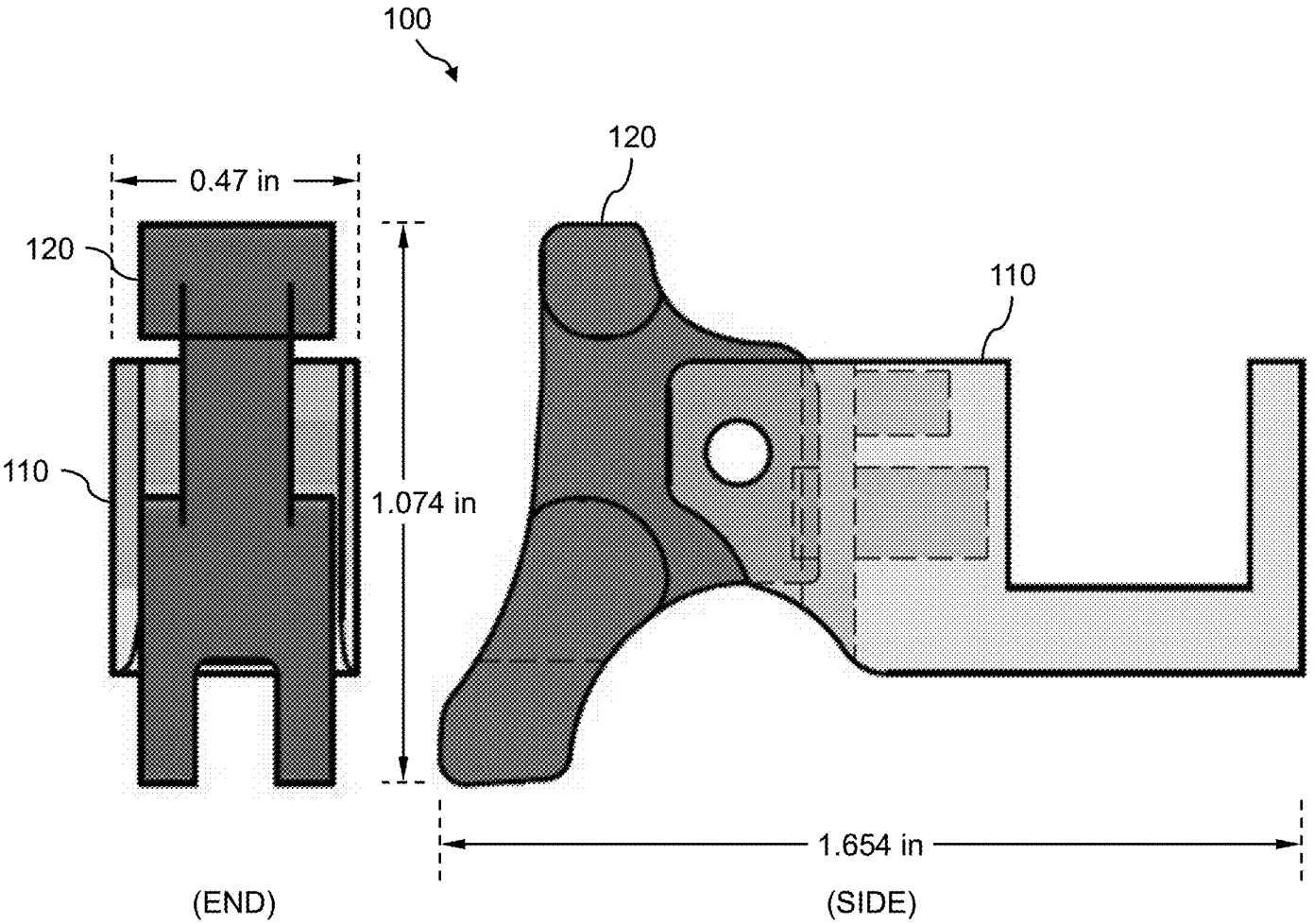
FIG. 3 illustrates example dimensions of the aided reset trigger mechanism shown in FIG. 1 and FIG. 2.

FIG. 3 shows a front and side view of the aided reset trigger mechanism 100. Included in FIG. 3 is one exemplification of a set of dimensions showing an approximate ratio of the height of the claimed aided reset trigger mechanism 100 in relation to its width for use in an AR-15 platform. Both the height and the width of the aided reset trigger mechanism 100 may be expanded or reduced so as to fit into the upper receivers of different firearm platforms and calibers.

Figure 4:
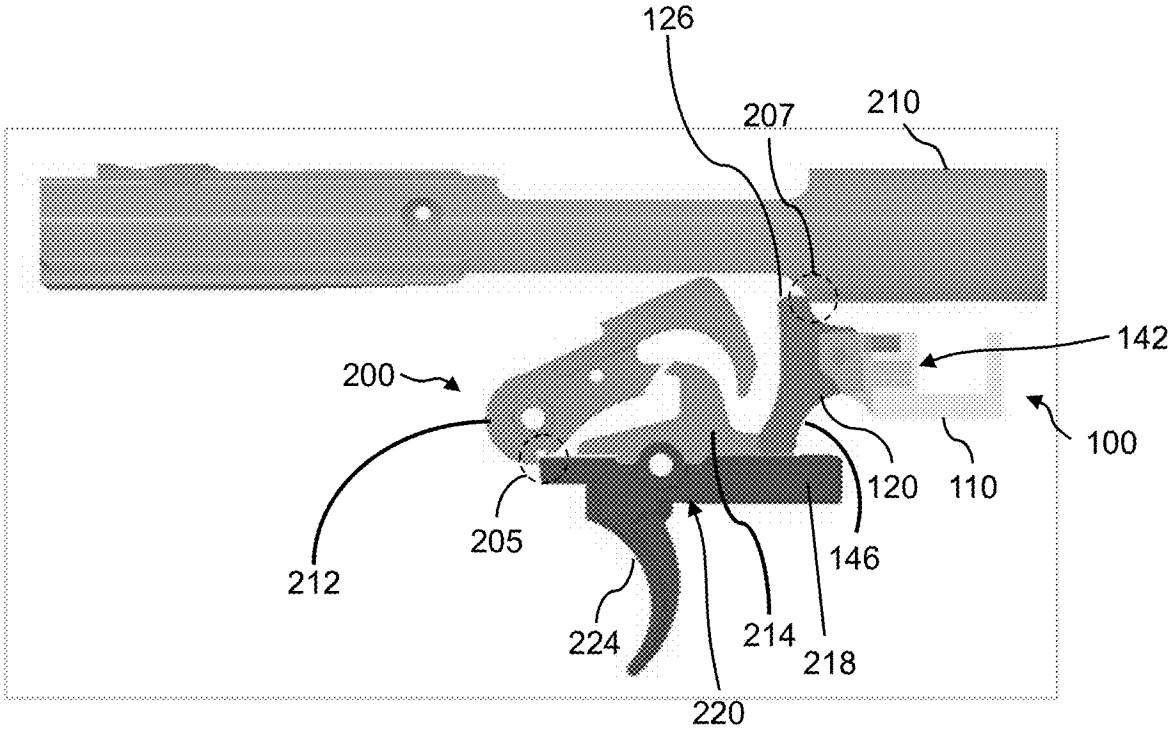
FIG. 4 through FIG. 7 illustrates an example of how pulling the trigger releases the front trigger sear, which in turn results in the rotational motion of the spring-loaded hammer forward.

Those skilled in the art will appreciate that in some embodiments, the design of the aided reset trigger mechanism 100 shown in FIG. 4 may allow for it to be utilized as a direct drop-in mechanism that is compatible for use with the existing upper receiver, as well as in conjunction with the existing bolt carrier group 210, rear trigger lever 218, disconnector 214, and existing lower trigger mechanism 220 for one or more semi-automatic firearm platforms. Referring now to FIG. 4, an exemplary orientation and arrangement of mechanism 100 in relation to the trigger 224, rear trigger lever 218, disconnector 214, bolt carrier group 210, and lower trigger mechanism 220 is presented. Specifically, FIG. 4 depicts the aided reset trigger mechanism 100 as it would be shown in a firearm platform that is in the charged state. A typical firearm platform may be charged, for example, using a charging handle coupled to the bolt carrier 210. In some platforms, pulling the charging handle (and therefore the connected bolt carrier group 210) backwards and then releasing it forward completes the charging process of a firearm platform. In some platforms, this process may be utilized to chamber a live round into the firearm chamber, and also engage the front trigger sear point 205 of the trigger assembly 200. Chambering a round into the chamber has no effect on the aided reset trigger mechanism 100. However, while in the charged state, the spring 142 located in base 110 of the aided reset trigger mechanism may in some embodiments maintain an outward force that contacts the rear of the paddle head 126, thereby ensuring the paddle head 126 remains in the proper orientation at all times of the cycle process.

Figure 5:
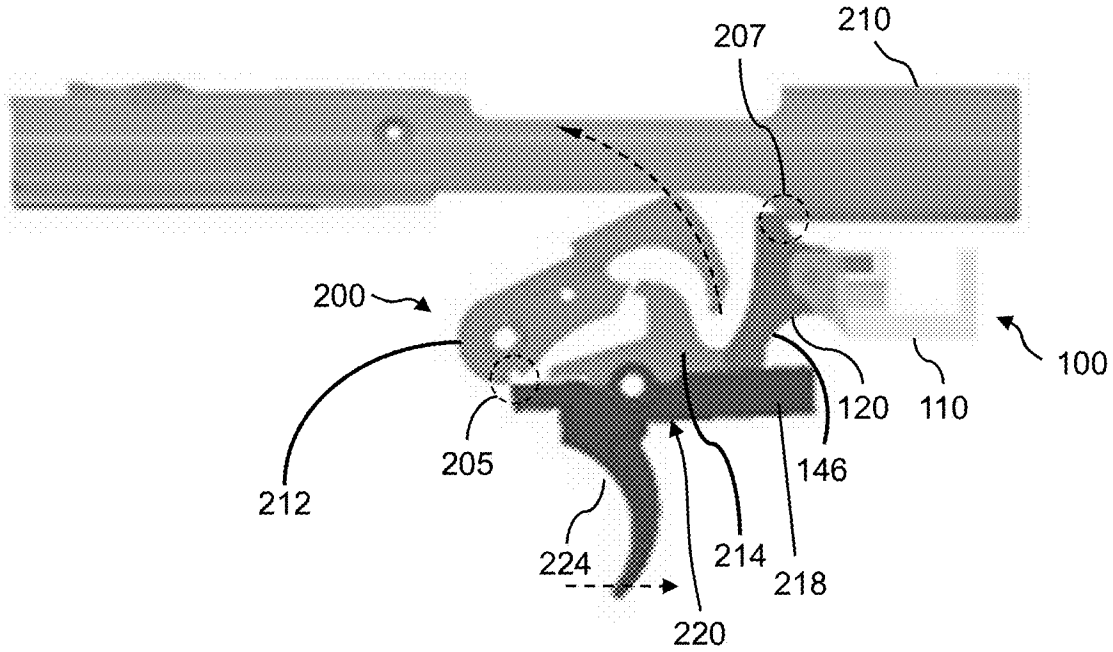
Figure 6:
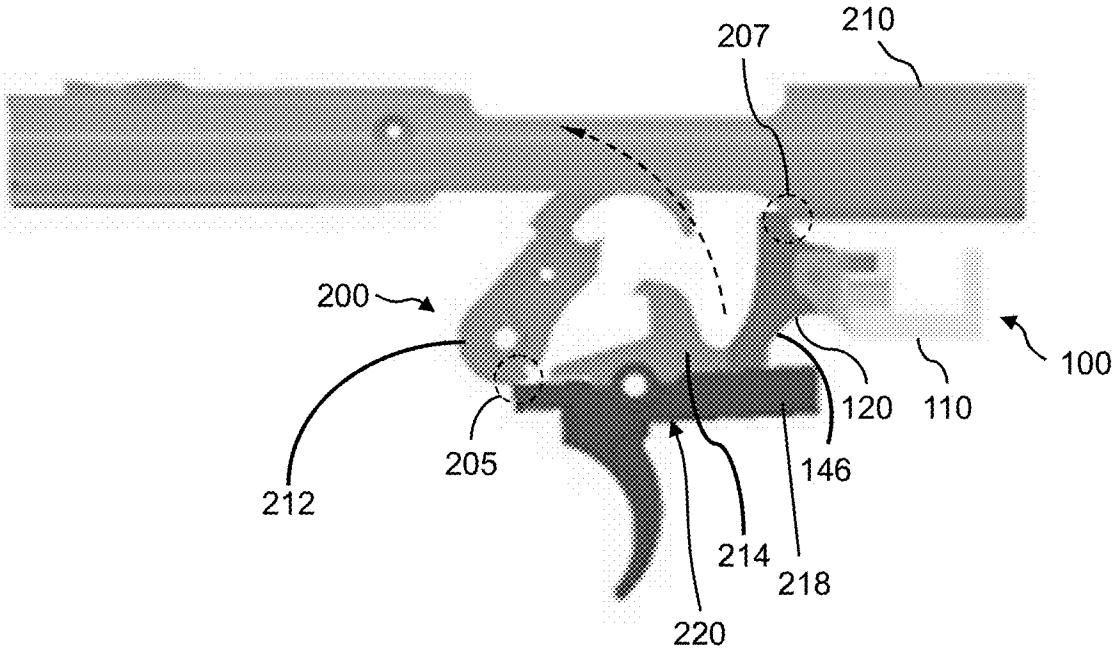
Figure 7:
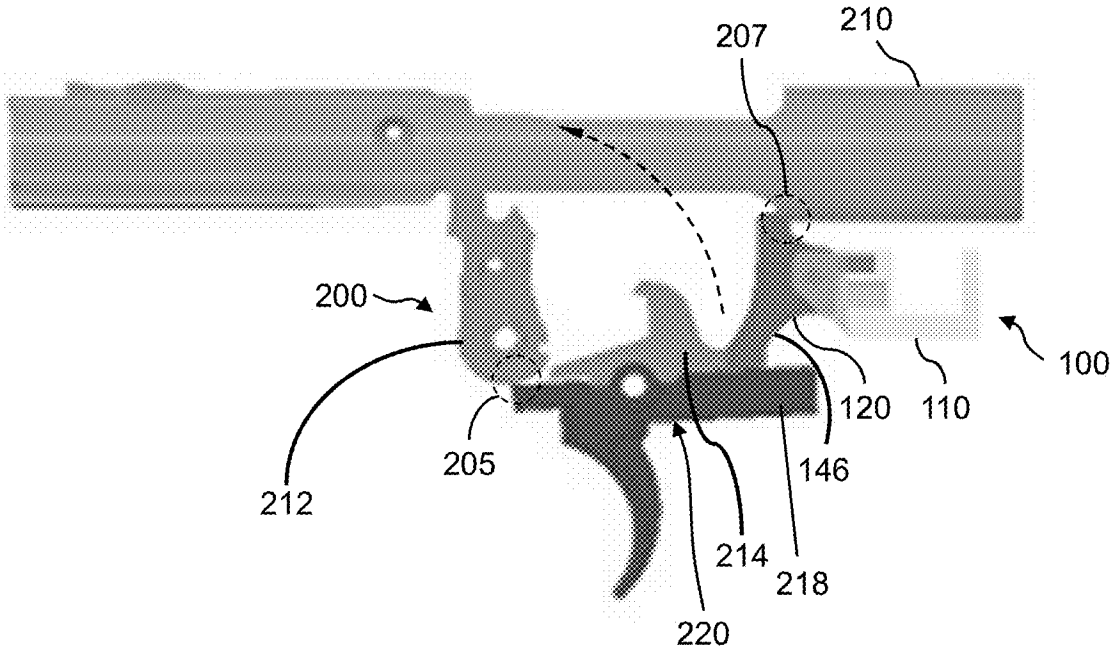

FIG. 5 depicts an exemplary first stage of one embodiment of an aided reset trigger mechanism 100. Specifically, FIG. 5 illustrates certain exemplary inner workings of the receiver of an already charged, live, firearm platform as the trigger 224 is depressed. It should be noted that as the trigger 224 is depressed, the front trigger sear point 205 may disengage, thereby releasing the spring-loaded hammer 212 in a counterclockwise motion forward. FIG. 5, FIG. 6, and FIG. 7 show the hammer 212 rotating counterclockwise as front trigger sear point 205 is released by the operator depressing the trigger 224. In FIG. 7, the hammer 212 has completed its counterclockwise rotation and has contacted the firing pin located within the bolt carrier group 210. A portion of the inertial force of the counterclockwise rotation of the hammer 212 may be transferred to the firing pin, which may be configured to strike a primer in a chambered cartridge and cause the gun powder within the chambered cartridge to ignite. This ignition causes gas pressure to rapidly increase within the chamber, forcing the projectile out of the end of the barrel. Those skilled in the art will appreciate that during this process in some embodiments, a portion of the gas is rerouted backwards through a gas tube to the upper receiver.

Figure 8:
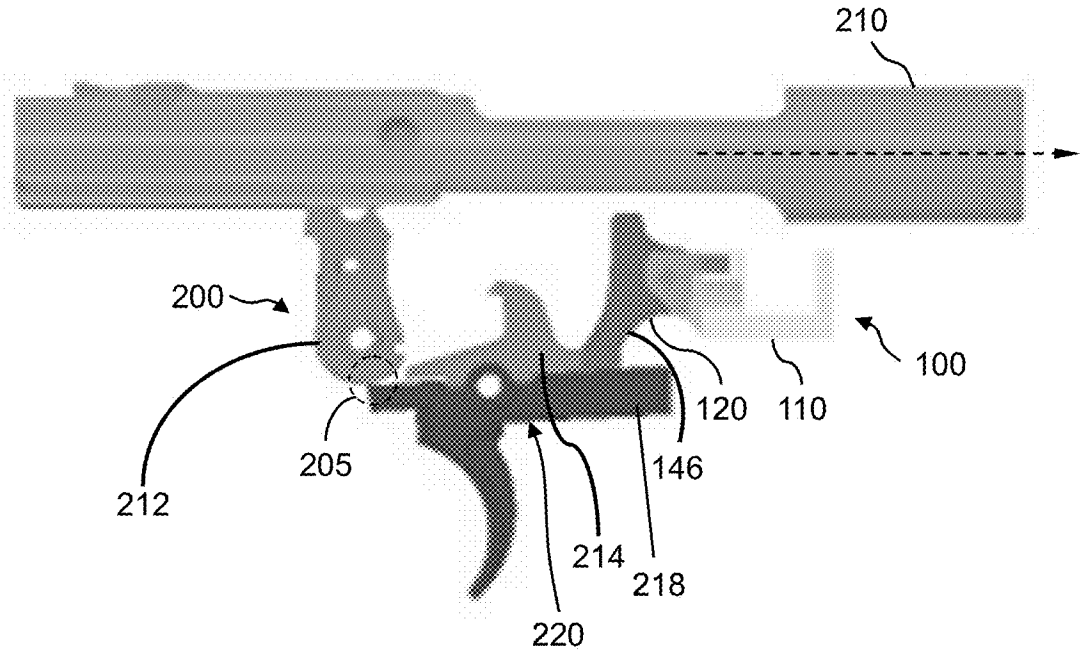
FIG. 8 illustrates how the forward rotating hammer contacts the striker, which results in the firing pin igniting the gunpowder contained within the chambered round.
Figure 9:
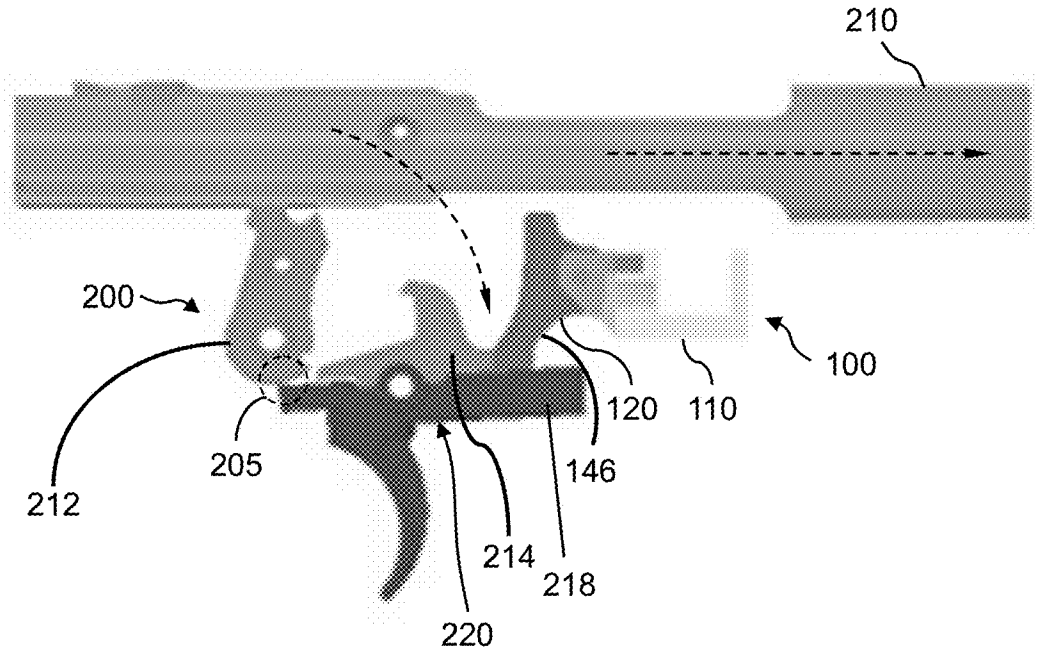
FIG. 9 through FIG. 12 illustrate an example of the bolt carrier group recoiling backwards, resulting in the hammer contacting the disconnector and engaging the disconnector sear point.
Figure 10:
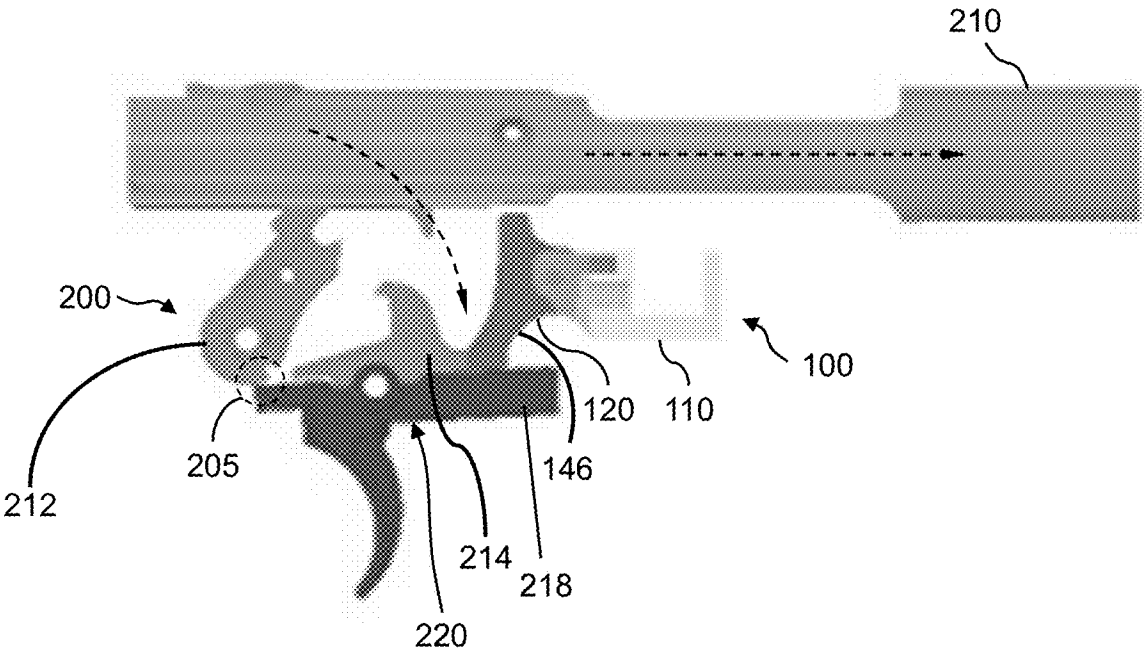
Figure 11:
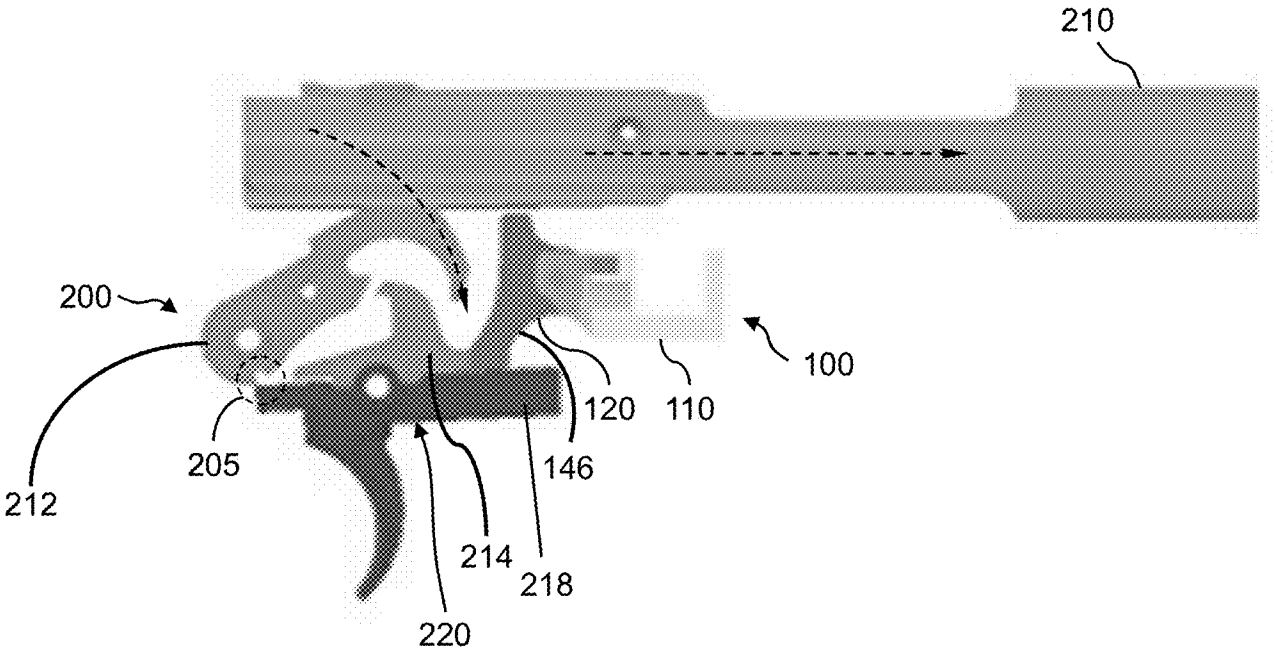
Figure 12:
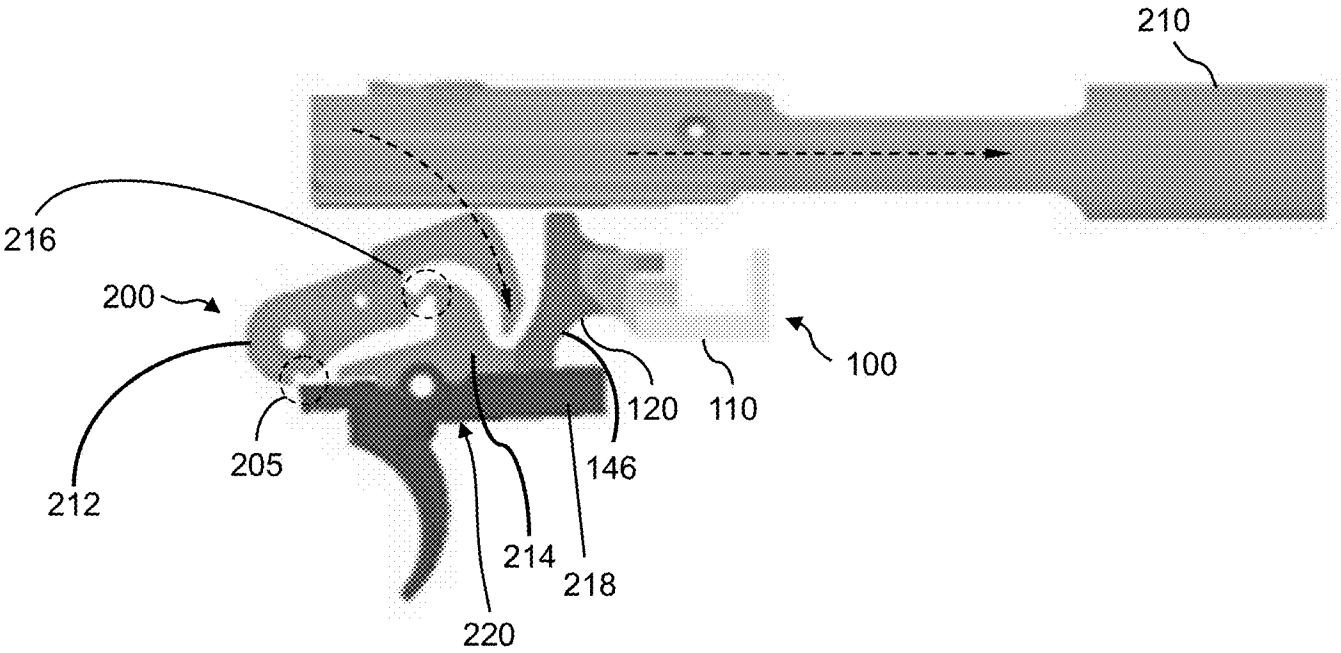

Gas that may be rerouted backwards to the upper receiver, for example, may be channeled toward the bolt carrier group 210, causing the bolt carrier group 210 to recoil linearly backwards as illustrated for example in FIG. 8. The recoiling bolt carrier group 210 may include multiple functions. For example, the recoiling bolt carrier group 210 may be responsible for ejecting the spent cartridge. In some embodiments of the present disclosure, however, the recoiling bolt carrier group 210 may, as shown in FIG. 9 through FIG. 11, contact and reset the hammer 212. More particularly, in some embodiments, as the bolt carrier group 210 recoils, a bottom portion of the bolt carrier group 210 may contact a top portion of the hammer 212 and effectively push it backwards in a clockwise motion. FIG. 12 illustrates that when the hammer 212 is pushed clockwise far enough by the recoiling bolt carrier group 210, it may temporarily engage the disconnector 214 at the disconnector sear point 216.

Figure 13:
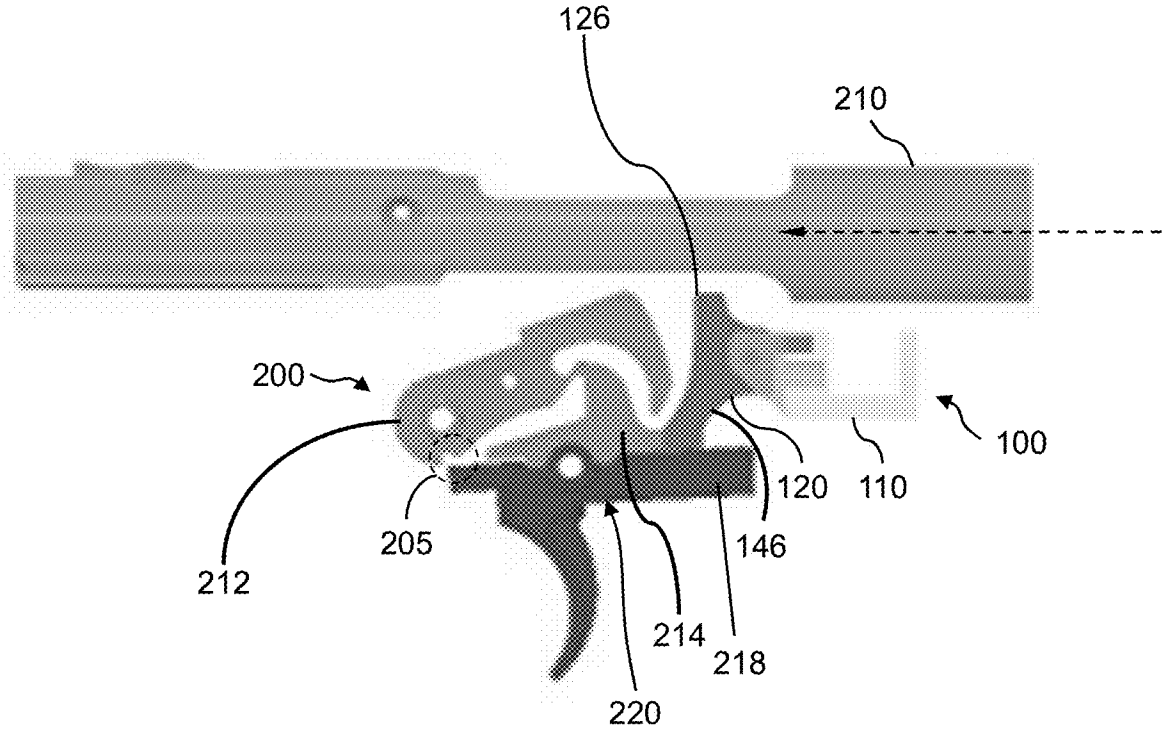
FIG. 13 through FIG. 17 illustrate an example of the bolt carrier group recoiling forward, contacting the paddle of the presently disclosed mechanism, and the paddle of the presently disclosed mechanism pivoting downward onto the rear trigger lever, thereby aiding in the reset of the trigger forward rapidly after each shot.
Figure 14:
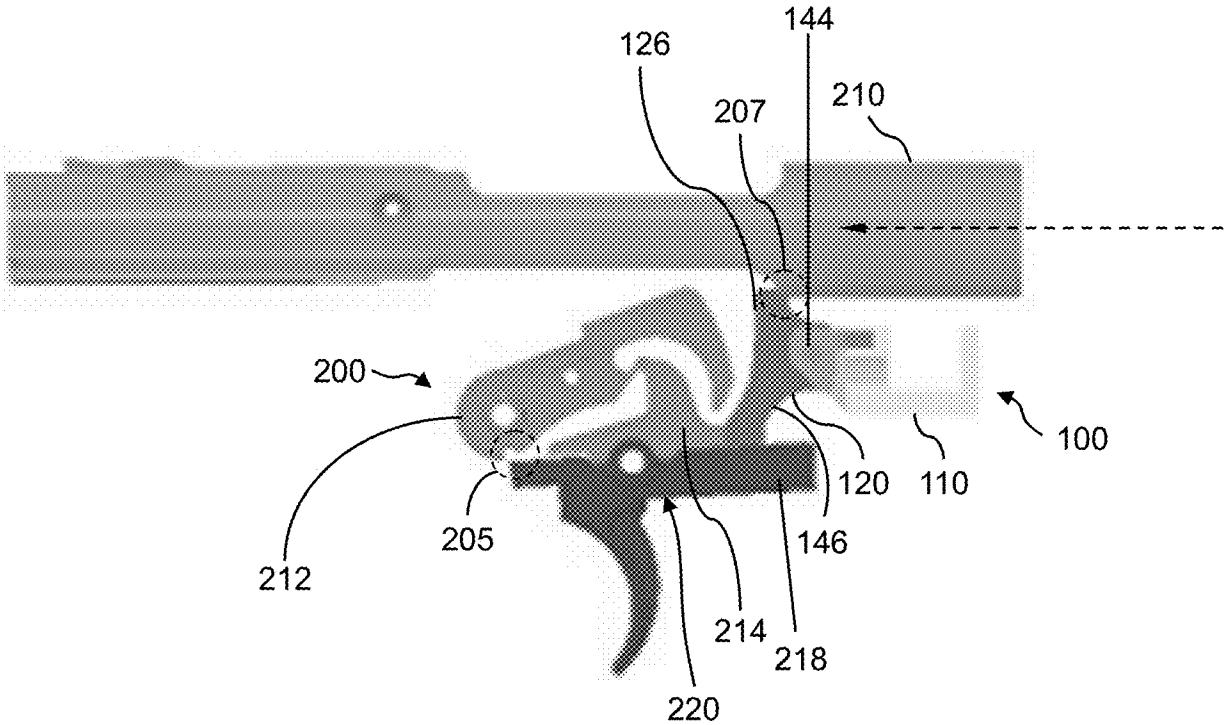

As the bolt carrier group recoils, it may also compress a buffer spring lying planarly behind it. FIG. 13 illustrates an example where the inertia of the bolt carrier group 210 becomes less than the potential energy of the recoil spring. At that point, the recoil spring may push the bolt carrier group 210 forward linearly toward the barrel of the firearm platform. The paddle head 126 located on the top portion of the paddle 120 of the aided reset trigger mechanism 100 may be situated partially in the forward recoiling path of the bolt carrier group 210. FIG. 14 illustrates an example where the forward recoiling bolt carrier group 210 may contact the paddle head 126 at the contact point 207 that lies partially in the forward recoiling path.

Figure 15:
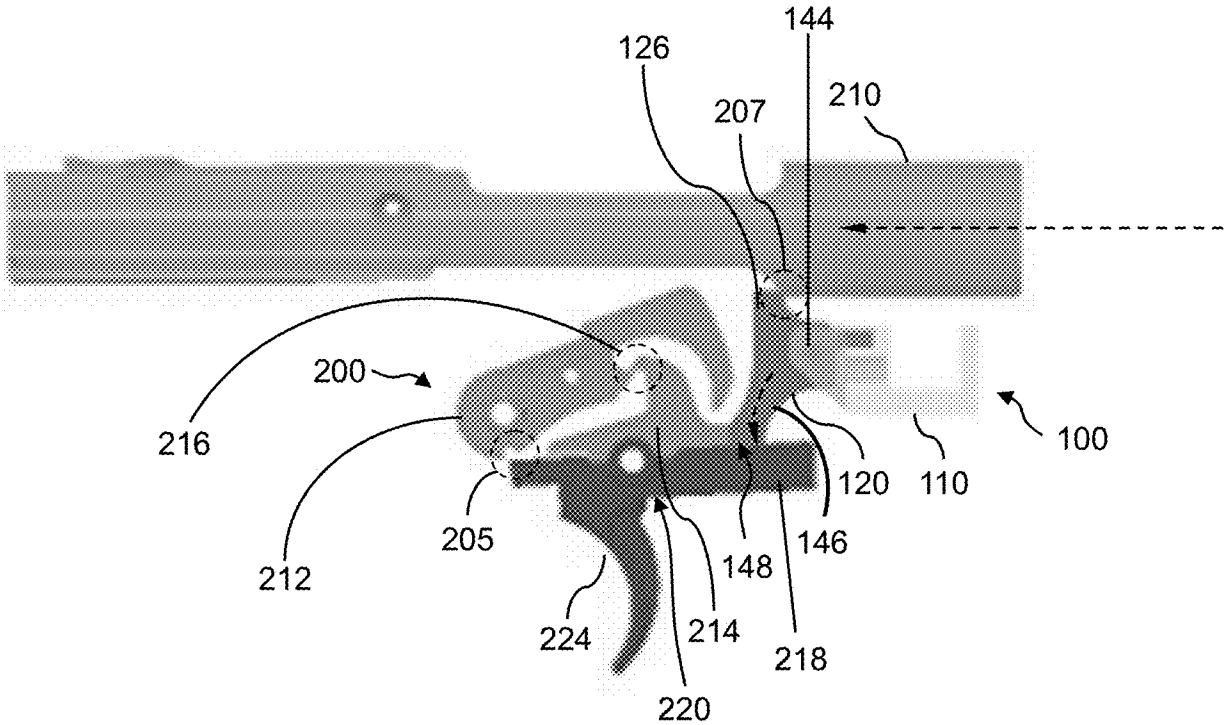
Figure 16:
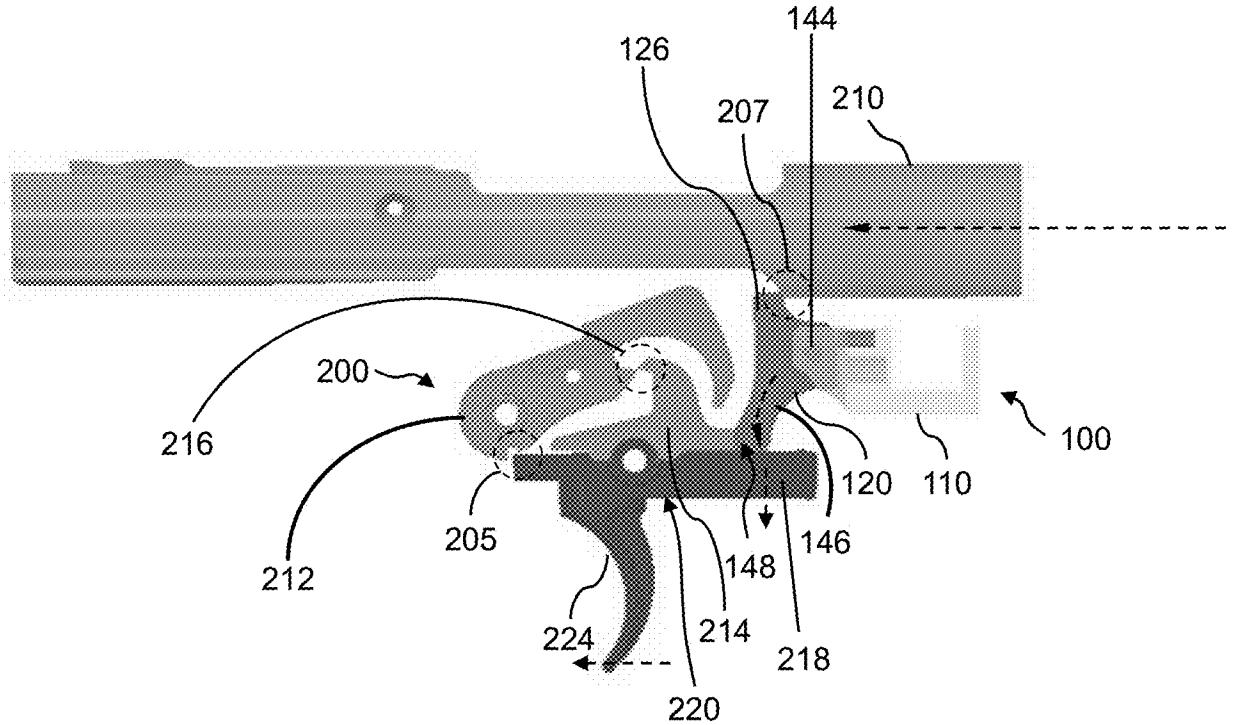

FIG. 15 illustrates an example where the bolt carrier group 210 may contact the paddle head 126, thereby aiding the paddle head 126 forward. As a result of the paddle head 126 being aided forward, the lower paddle 146 may be pivoted downward and backwards via the rotating pin 144. As the lower paddle 146 pushes downward, the two paddle legs 148 may contact the top surface of the rear trigger lever 218. FIG. 16 illustrates how this contact between the two paddle legs 148 and the top surface of the rear trigger lever 218 may aid the rear trigger lever downward. As the rear trigger lever 218 is pushed downward, the trigger 224 may be aided forwards as the lower trigger mechanism 220 is rotated clockwise from the pivoting downward force of the lower paddle 146.

Figure 17:
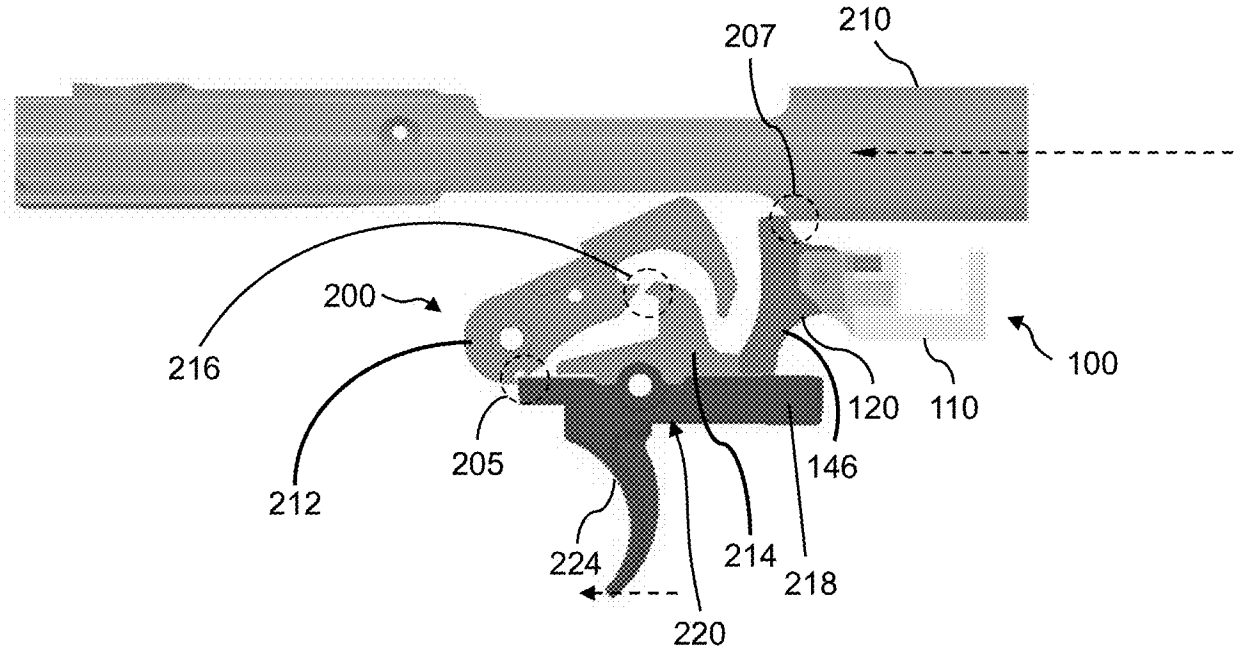

In some embodiments, as the trigger 224 is reset by the downward motion of the lower paddle 146, FIG. 17 illustrates an example of how the front trigger sear point 205 may simultaneously reengage. FIG. 15 through FIG. 17 illustrate that after the front trigger sear point 205 reengages, the disconnector sear point 216 may disengage. Simultaneously, while aiding in resetting the trigger 224 forward, the bolt carrier group 210 may also chamber an unspent cartridge. One skilled in the art will appreciate that, in such embodiments, by the time both the hammer 212 has reengaged, and the mechanism 100 has aided in resetting the trigger 224 forward, an unspent cartridge has been chambered, and the firearm platform is ready to be fired immediately thereafter. One skilled in the art will also appreciate that the bolt carrier group 210 recoils forward and may pass enough energy onto and through the aided reset trigger mechanism to overcome the typical trigger pull. Accordingly, an operator may apply a constant pressure to the trigger, while also allowing the trigger to reset forward after each round is fired. The entire recoil and return to battery process of the bolt carrier group 210 may occur more rapidly than the average or even advanced operator can manually release their finger off of the trigger 224. Proper use of the aided reset trigger mechanism 100 may allow for a more rapid-fire rate, while ensuring that the trigger physically resets after each round in order to maintain compliance with, among other things, applicable governing bodies and regulations.

Additionally, one skilled in the art will appreciate that the radial shape on the rear face of the lower paddle 146, as well as the radial shape on the front face of the base 110, may allow for the typical safety and select fire mechanism commonly employed in such firearm platforms to advantageously remain fully functional without modification.

While various embodiments of the present disclosure have been described in detail, it should be apparent that modifications and variations thereto are possible, all of which fall within the true spirit and scope of the disclosure. Therefore, the foregoing is intended only to be illustrative of the principles of the disclosure. Further, since numerous modifications and changes will readily occur to those skilled in the art, it is not intended to limit the disclosure to the exact construction and operation shown and described. Accordingly, all suitable modifications and equivalents may be included and considered to fall within the scope of the disclosure, defined by the following claim or claims.

What is claimed is:

1. A trigger reset apparatus comprising:

a base comprising a spring, a stop pin, and a pair of parallel legs; and a paddle pivotally coupled to the parallel legs of the base with a rotating pin, wherein energy from a recoiling bolt carrier group drives the paddle to aid in resetting a trigger forward after each shot.

2. The apparatus of claim 1 wherein a bottom portion of the paddle rests atop a trigger lever and comprises a straddle slot that straddles a disconnector.

3. The apparatus of claim 2 wherein the bottom portion of the paddle rests directly behind a disconnector without contacting the disconnector.

4. The apparatus of claim 2 wherein the rotating pin allows the paddle to tilt forwards and backwards within a controlled range of tilts limited by the spring and the stop pin.

5. The apparatus of claim 1 wherein a top portion of the paddle remains tilted forward and the bottom portion of the paddle remains tiled backward, thereby compressing the spring.

6. The apparatus of claim 1 wherein the a top portion of the paddle tilts back and a bottom portion of the paddle tilts forward as a result of the trigger pushing the bottom portion of the paddle forward and upward when an external portion of the trigger is actuated.

7. The apparatus of claim 1 wherein the spring biases the paddle such that a top portion of the paddle remains stationary against the stop pin.

8. The apparatus of claim 1 wherein a top portion of the paddle rests directly in a recoil path of the recoiling bolt carrier group so that when the recoiling bolt carrier group recoils forward from a force, an edge contacts the top portion of the paddle, thereby causing the top portion of the paddle to tilt forward and a bottom portion of the paddle to tile backward and downward.

9. The apparatus of claim 1 wherein backwards and downward tilting of a bottom portion of the paddle cause the trigger to be pressed downward, resulting in an external portion of the trigger being reset.

* * * * *